United States Patent [19]

Makino et al.

[11] Patent Number: 4,806,459

[45] Date of Patent: Feb. 21, 1989

[54] COLOR PHOTOGRAPHIC MATERIAL YELLOW AND CYAN DYE FORMING COUPLERS AND COMPOUND WHICH PRODUCES A DIFFUSIBLE DEVELOPMENT INHIBITOR OR A PRECURSOR IN A BLUE SENSITIVE LAYER

[75] Inventors: Katsumi Makino; Noboru Sasaki; Koji Takahashi, all of Kanagawa, Japan

[73] Assignee: Fuji Photo Film Co., Ltd., Kanagawa, Japan

[21] Appl. No.: 47,517

[22] Filed: May 6, 1987

Related U.S. Application Data

[63] Continuation-in-part of Ser. No. 849,657, Apr. 9, 1986, abandoned.

[30] Foreign Application Priority Data

Apr. 9, 1985 [JP] Japan ..... 60-77488

[51] Int. Cl.[4] ..... G03C 1/08; G03C 1/46; G03C 7/26; G03C 7/32

[52] U.S. Cl. ..... 430/544; 430/382; 430/504; 430/505; 430/549; 430/553; 430/555; 430/558; 430/956; 430/957; 430/958

[58] Field of Search ..... 430/504, 505, 544, 549, 430/956, 957, 958, 382, 553, 555, 558

[56] References Cited

U.S. PATENT DOCUMENTS 3,990,899 11/1976 Shiba et al. ..... 430/362
4,273,861 6/1981 Shiba et al. ..... 430/504 X
4,500,634 2/1985 Sakanoue et al. ..... 430/555 X

FOREIGN PATENT DOCUMENTS 0114675 1/1984 European Pat. Off. .

*Primary Examiner*—Mukund J. Shah
*Attorney, Agent, or Firm*—Sughrue, Mion, Zinn, Macpeak & Seas

[57] ABSTRACT

A color photographic material comprising a support having provided thereon a blue-sensitive silver halide emulsion layer containing at least one coupler capable of reacting with an oxidation product of an aromatic primary amine developing agent to form a yellow dye, at least one coupler capable of reacting with said oxidation product to form a cyan dye and not to produce a diffusible development inhibitor or a precursor thereof, and at least one compound capable of reacting with said oxidation product to produce a diffusible development inhibitor or a precursor thereof.

15 Claims, 5 Drawing Sheets

COLOR PHOTOGRAPHIC MATERIAL YELLOW AND CYAN DYE FORMING COUPLERS AND COMPOUND WHICH PRODUCES A DIFFUSIBLE DEVELOPMENT INHIBITOR OR A PRECURSOR IN A BLUE SENSITIVE LAYER

This is a continuation in part of application Ser. No. 849,657 filed Apr. 9, 1986 now abandoned.

FIELD OF THE INVENTION

This invention relates to a color photographic light-sensitive material excellent in color reproducibility and, more particularly, to a color photographic light-sensitive material which forms an image having excellent sharpness, and which enables reproduction of color with high fidelity.

BACKGROUND OF THE INVENTION

It has conventionally been known to utilize an interlayer inhibition effect for improving color reproducibility of color photographic light-sensitive materials. Gradation of color negative paper is balanced to reproduce gray on a color print when exposed using white light, and hence the interlayer effect provides monochromatic coloration of higher density when separation exposure is conducted than when gray exposure is conducted. As a result, reproduction of primary colors with high saturation can be attained on color prints.

As a specific technique for obtaining the interlayer effect, it has been known to use iodide ion released from a silver halide emulsion upon development. This technique raises the content of silver iodide in an interlayer effect-providing layer and reduces the content of silver iodide in an interlayer effect-receiving layer. Another technique for raising the interlayer effect is a technique of incorporating in an interlayer effect-providing layer a coupler capable of reacting with an oxidation product of a p-phenylenediamine type color developing agent in a color developer solution to release a development inhibitor, as disclosed in Japanese Patent Application (OPI) No. 2537/75 (the term "OPI" as used herein refers to a "published unexamined Japanese patent application").

Iodide ion and a development inhibitor to be released from a DIR compound are known to provide not only the interlayer effect but higher sharpness due to the horizontal Everhard effect by diffusion in a direction at a right angle with incident light in the layer where they exist. Particularly, as is disclosed in European Patent No. 101,621 and Japanese Patent Application No. 7150/83, this effect is remarkable with inhibitors or development inhibitor precursors having high diffusibility. However, a raised fine line contrast of 10 lines/mm on film utilizing this horizontal Everhard effect results in some problems. For example, an originally yellow-green color is reproduced as a yellow color on the print, making discrimination between a yellow-green color and a yellow color difficult.

The inventors have formerly found that addition of a DIR compound capable of releasing a development inhibitor with a high diffusibility to a blue-sensitive layer is effective for raising saturation of green color and image sharpness of the blue-sensitive layer, but have found that this addition has a problem with reproducibility of yellow-green color. Thus the invention have conducted intensive investigations to solve this problem.

SUMMARY OF THE INVENTION

It is, therefore, an object of the present invention to provide a color photographic light-sensitive material which forms a yellow color-containing image with excellent sharpness, highly saturated green color, and well reproduced yellow-green color.

This object of the present invention can be attained by a silver halide color photographic light-sensitive material which comprises a support having provided thereon a blue-sensitive silver halide emulsion layer containing at least one coupler capable of reacting with an oxidation product of an aromatic primary amine developing agent to form a yellow dye, at least one coupler capable of reacting with the oxidation product to form a cyan dye and not to produce a diffusible development inhibitor or a precursor thereof, and at least one compound capable of reacting with the oxidation product to produce a diffusible development inhibitor or a precursor thereof.

The object of the present invention also can be attained by a silver halide color photographic light-sensitive material which comprises a support having provided thereon a blue-sensitive silver halide emulsion layer containing at least one coupler capable of reacting with an oxidation product of an aromatic primary amine developing agent to form yellow dye, and at least one coupler capable of reacting with said oxidation product to produce both a cyan dye and a diffusible development inhibitor or a precursor thereof.

DETAILED DESCRIPTION OF THE INVENTION

Figure 1:
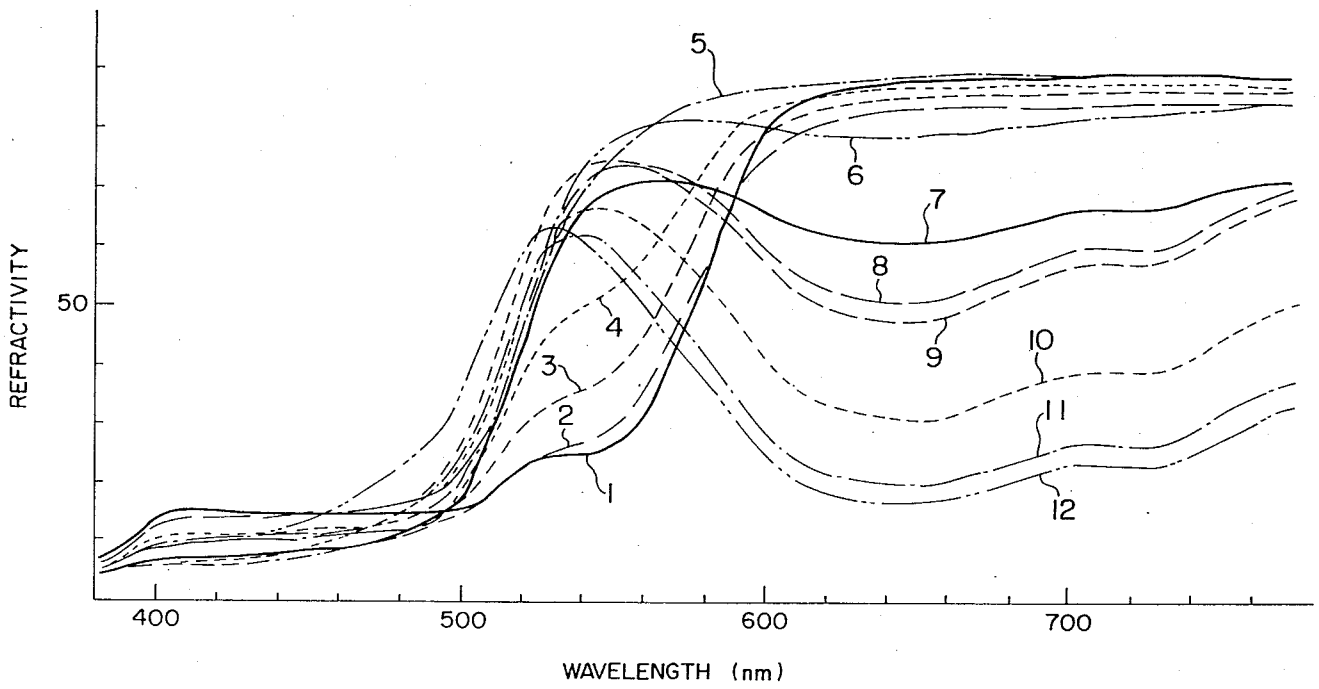
FIG. 1 shows spectral reflectivities of a color chart used for conducting comparative tests on color reproducibility.

A preferable embodiment of the present invention is as follows: a silver halide color photographic light-sensitive material comprising a support having provided thereon at least one yellow coupler-containing blue-sensitive silver halide emulsion layer, at least one magenta coupler-containing green-sensitive silver halide emulsion layer, and at least one cyan coupler-containing red-sensitive silver halide emulsion layer in this order, either with the blue-sensitive silver halide emulsion layer further containing at least one compound capable of reacting with an oxidation product of a color developing agent to produce a development inhibitor or a precursor thereof with a high diffusibility and at least one cyan coupler which does not produce a development inhibitor or a precursor thereof, or with the blue-sensitive silver halide emulsion layer further containing at least one coupler capable of reacting with an oxidation product of a color developing agent to produce a cyan dye and a diffusible development inhibitor or a precursor thereof.

The cyan coupler is thus present in the blue-sensitive layer, and the cyan coupler and the compound capable of reacting with an oxidation product of a color developing agent to produce a development inhibitor or a precursor thereof are present in the same blue-sensitive layer. See the above discussion and the 9th layer composition of the later presented Samples 104 and 105.

The aromatic primary amine developing agent and the oxidation product thereof in the present invention are disclosed in T. H. James, *The Theory of the Photographic Process*, 4th edition, Macmillan (1977), pp. 339–352, and the references cited in this literature.

The compounds of the present invention capable of producing a diffusible development inhibitor or a precursor thereof are roughly grouped into so-called DIR couplers and DIR hydroquinones. Of these, DIR couplers are preferred, with couplers capable of releasing a development inhibitor with high diffusibility being particularly preferred.

As the DIR couplers, there are illustrated, for example, those compounds which release a heterocyclic mercapto type development inhibitor, described in U.S. Pat. No. 3,227,554, etc.; those which release a benzotriazole derivative as a development inhibitor, described in Japanese Patent Publication No. 9942/83, etc.; so-called non-color-forming DIR couplers described in Japanese Patent Publication No. 16141/76; those compounds which release, after elimination, a nitrogen-containing heterocyclic development inhibitor accompanied by decomposition of methylol, described in Japanese Patent Application (OPI) No. 90932/77; those compounds which release a development inhibitor after elimination accompanied by intramolecular nucelophilic reaction, described in U.S. Pat. No. 4,248,962; those compounds which release, after elimination, a development inhibitor by electron shift via a conjugation system, described in Japanese Patent Application (OPI) Nos. 114946/81, 56837/82, 154234/82, 188035/82, 98728/83, 209736/83, 209737/83, 209738/83, 209740/83, etc.; those compounds which release a diffusible development inhibitor to be deactivated as to development-inhibiting ability in a developer, described in Japanese Patent Application (OPI) Nos. 151944/82, 217932/83, etc.; those compounds which release a reactive compound to produce or deactivate a development inhibitor by the reaction in the layer upon development, described in Japanese Patent Application Nos. 38263/84, 39653/84, etc.; and the like. Of the above-described DIR couplers, those which release a development inhibitor or the like with high diffusibility are preferable, including the developer-deactivated type represented by those described in Japanese Patent Application (OPI) No. 151944/82; the timing type represented by those described in Japanese Patent Application (OPI) No. 154234/82; and the reaction type represented by those described in Japanese Patent Application No. 39653/84. Particularly preferable are the developer-deactivated type DIR couplers described in Japanese Patent Application (OPI) No. 151944/82, etc. and the reaction type DIR couplers described in Japanese Patent Application No. 39653/84.

Compounds particularly effective in the present invention, which produce a highly diffusible development inhibitor or a precursor thereof, are those which release the above-described development inhibitor or the like upon coupling with a color developing agent, and are represented by the following general formula:

$$J\text{—}Y)_h \qquad (I)$$

wherein J represents a coupler moiety, h represents 1 or 2, and Y represents a group which is bound to the coupler moiety, J, at a coupling position of J, and which can be released upon reaction with an oxidation product of a color developing agent and can produce a highly diffusible development inhibitor or a precursor thereof (having preferably a diffusibility of 0.4 or more measured according to the method described hereinafter).

In the general formula (I), specifically, Y represents one of the following general formulae (II) to (V):

General formula (II)

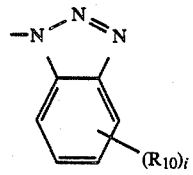

General formula (III)

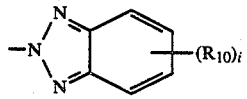

General formula (IV)

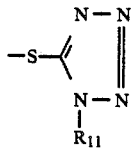

General formula (V)

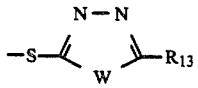

wherein W represents —S— or —N($R_{12}$)—; $R_{10}$, $R_{11}$, $R_{12}$, and $R_{13}$ each represents particular substituents defined hereinafter so selected as to give a diffusibility of 0.4 or more; and i represents 1 to 4.

Examples of the selected substituent represented by $R_{10}$ includes $CH_3$— (provided that i=2), Br— (i=1; hereinafter the same), —NHCOR′ (R′ containing 3 to 7 carbon atoms), —$NHSO_2R'$ (R′ containing 4 to 8 carbon atoms), —OR′ (R′ containing 2 to 5 carbon atoms), —R′ (containing 1 to 3 carbon atoms),

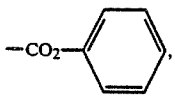

and —$CO_2R'$ (R′ containing 2 to 6 carbon atoms). —R′ as used herein represents a substituted or unsubstituted, linear, cyclic, or branched aliphatic group.

Examples of the substituent represented by $R_{11}$ include an ethyl group, a propyl group, a hydroxy-substituted phenyl group, an amino-substituted phenyl group, a sulfamoyl-substituted phenyl group, a carboxy-substituted phenyl group, a methoxycarbonyl-substituted phenyl group, a 3-methoxyphenyl group, —$(CH_2)_{2-3}COOR'$ (R′ containing 2 to 3 carbon atoms),

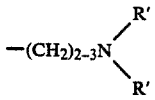

(two R's being the same or different, and each containing 2 to 3 carbon atoms), $-(CH_2)_2OCH_3$, a 3-carbamoylphenyl group, and a 3-ureidophenyl group, with R' being the same or defined for $R_{10}$.

Examples of $R_{12}$ include a hydrogen atom or an alkyl group containing 1 to 4 carbon atoms, and examples of $R_{13}$ include an amino group, —NHCOR' (R' containing 1 to 6 carbon atoms),

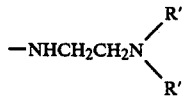

(wherein R's may be the same or different, and each represents a methyl or ethyl group), an ethyl group, a propyl group, $-(CH_2)_{2-3}COOH$, and $-(CH_2)_{2-4}SO_3H$.

Diffusibility of development inhibitor is evaluated according to the following method.

A two-layered light-sensitive material comprising a transparent support having provided thereon the two layers of the following formulations was prepared (Sample B).

First layer: Red-sensitive silver halide emulsion layer

A layer formed by coating a gelatin coating solution containing an emulsion prepared by using sensitizing dye I of Example 1 in a silver bromoiodide emulsion (silver iodide: 5 mol%; mean grain size: 0.4μ) in an amount of $6\times10^{-5}$ mol per mol of silver to give red sensitivity and coupler X in an amount of 0.0015 mol per mol of silver, in a coated silver amount of 1.8 g/m² (2μ in thickness).

Coupler X:

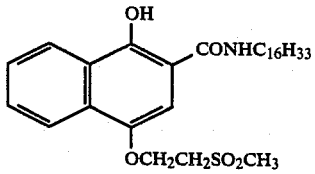

Second layer

A gelatin layer containing the silver bromoiodide emulsion used in the first layer (except for having no red sensitivity) and polymethyl methacrylate particles (about 1.5μ in diameter (2 g/m² in coated silver amount; 1.5μ in thickness).

Each of these layers contained a gelatin hardener and a surfactant in addition to the above-described formulations.

A light-sensitive material having the same structure as Sample B except for not containing the silver bromoiodide emulsion in the second layer of Sample B was prepared as Sample A.

The thus obtained Samples A and B were wedge exposed and processed in the same manner as in Example 1 except for changing the developing time to 2 minutes and 10 seconds. A development inhibitor was added to the developer in such an amount that the density of Sample A decreased to ½. The degree of decreases in density of Sample B thus processed was employed as a measure of diffusibility in the silver halide emulsion layer.

In general formula (I), Y further represents the following general formula (VI):

—TIME—INHIBIT (VI)

wherein TIME represents a group bound to the coupler in its coupling position and capable of being split by the reaction with a color developing agent and, after being split from the coupler, capable of releasing INHIBIT at a properly controlled rate, and INHIBIT represents a development inhibitor.

Preferable examples of the TIME-group are those represented by the general formulae (VII) to (XIII) described in European Patent No. 101,621.

Examples of a yellow color image-forming coupler residue represented by J in general formula (I) include pivaloylacetanilide type, benzoylacetanilide type, malondiester type, malondiamide type, dibenzoylmethane type, benzothiazolylacetamide type, malon ester monoamide type, benzothiazoly acetate type, benzoxazolylacetamide type, benzoxazolylacetate type, malon diester type, benzimidazolylacetamide type or benzimidazolylacetate type coupler residues; coupler residues derived from hetero ring-substituted acetamides or hetero ring-substituted acetates are described in U.S. Pat. No. 3,841,880, coupler residues derived from acylacetamides are described in U.S. Pat. No. 3,770,446, British Patent No. 1,459,171, West German Patent Application (OLS) No. 2,503,099, Japanese Patent Application (OPI) No. 139738/75 or Research Disclosure, 15737, and heterocyclic coupler residues described in U.S. Pat. No. 4,046,574.

As a magenta color image-forming coupler residue represented by J, coupler residues containing a 5-oxo-2-pyrazoline nucleus, a pyrazolo(1,5-a)benzimidazole nucleus, a pyrazolo(5,1-c)(1,2,4)triazole nucleus, a pyrazolo(1,5-b)(1,2,4)triazole nucleus, or a cyanoacetophenone type coupler residue are preferable.

As a cyan color image-forming coupler residue represented by J, coupler residues containing a phenol nucleus or an alpha-naphthol nucleus are preferable.

Further, those coupler residues which form substantially no dyes after coupling with an oxidation product of a developing agent can exert the same effect in terms of the effect as a DIR coupler. As this type of coupler residue represented by J, there are illustrated those coupler residues which are described in U.S. Pat. Nos. 4,052,213, 4,088,491, 3,632,345, 3,958,993 and 3,961,959.

In general formula (I), J preferably represents that represented by general formulae (IA) to (IXA) described in European Patent No. 101,621.

Preferable speecific compounds are Compounds D-1 to D-47 described in the specification of the above-mentioned reference. The first six examples of these compounds are shown below.

D-1
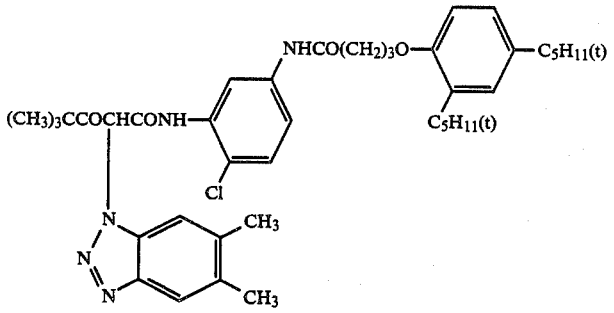
D-2
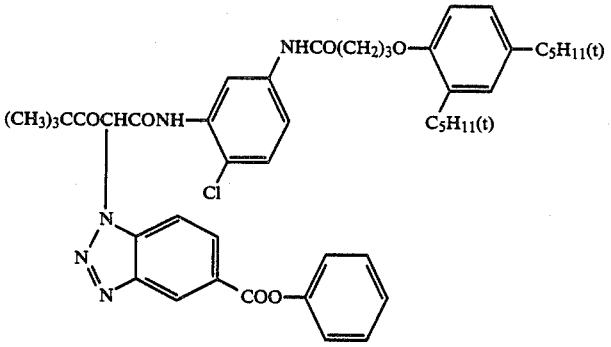
or
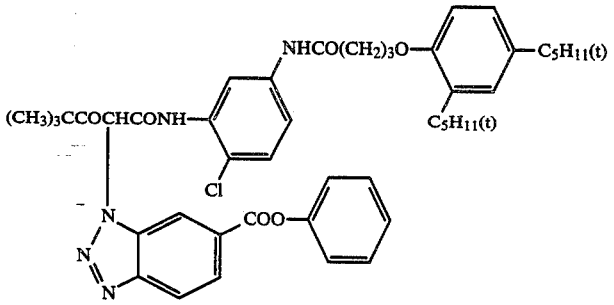
D-3
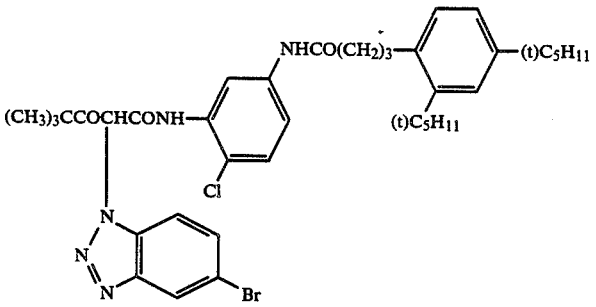
D-4
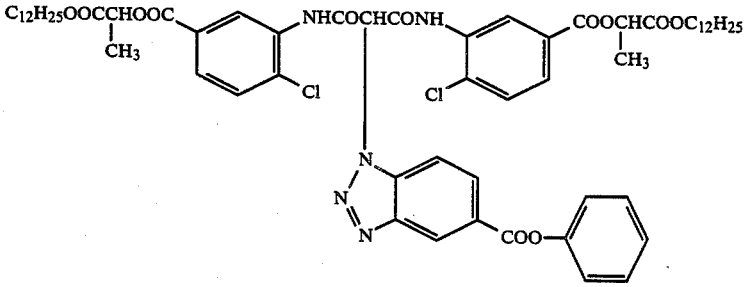

-continued or

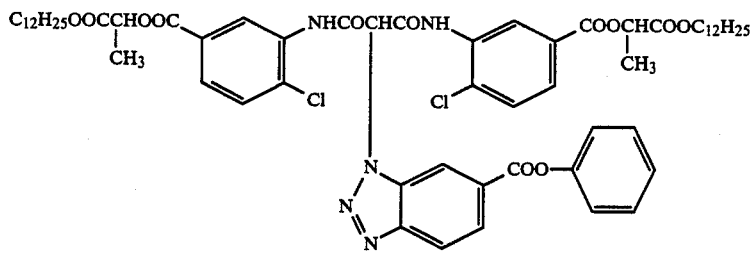

D-5

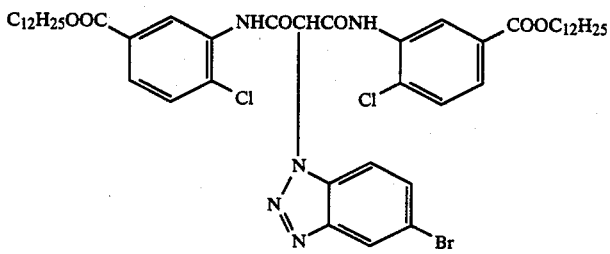

D-6

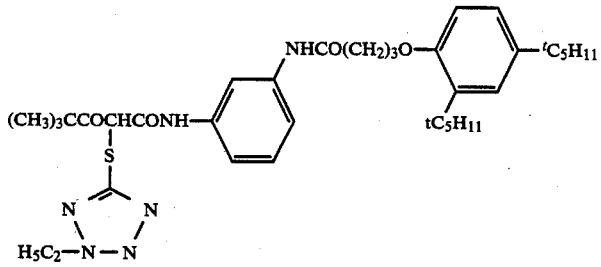

A compound which produces a diffusible development inhibitor or a precursor thereof particularly preferable in the present invention is a DIR coupler which, after a compound showing development-inhibiting effect is released into a color-developing solution, is decomposed into a compound exerting substantially no influence on photographic properties, and can be represented by the following general formula (VII):

$$J-(L_1)_a-Y-L_2-Z)_b \quad \text{(VII)}$$

wherein J represents a coupler moiety as with the general formula (I), Y represents an essential moiety of a compound showing development-inhibiting effect, and is bound to the coupling position of the coupler moiety directly (a=0) or through linking group $L_1$ (a=1).

Z represents a substituent bound to Y through linking group $L_2$ and capable of making the development-inhibiting effect of Y emerge. The linking group represented by $L_2$ contains a chemical bond to be split in a developer.

a represents 0 or 1, and b represents 1 or 2. When b represents 2, two $(-L_2-Z)$'s may be the same or different from each other.

After coupling with an oxidation product of a color-developing agent, the compounds represented by the general formula (VII) release $\ominus Y-(L_2-Z)_b$ or $\ominus L_1-Y-(L_2-Z)_b$. The latter immediately undergoes splitting of $L_1$ to become $\ominus Y-(L_2-Z)_b$. $\ominus Y-(L_2-Z)_b$ diffuses through a light-sensitive layer showing a development inhibiting effect, part of which is carried away into the color development processing solution. $\ominus Y-(L_2-Z)_b$ carried away into the processing solution is rapidly decomposed at a chemical bond portion contained in $L_2$, i.e., Y and Z are split from each other, leaving a compound having a small development-inhibiting effect in which a hydrophilic group is bound to Y in the developer. Thus, the development-inhibiting effect substantially vanishes.

As a yellow color image-forming coupler residue represented by Y, there are illustrated pivaloylacetanilide type, benzoylacetanilide type, malon diester type, malon diamide type, dibenzoylmethane type, benzothiazolylacetamide type, malon ester monoamide type, benzothiazolylacetate type, benzoxazolylacetamide type, benzoxazolylacetate type, malon diester type, benzimidazolylacetamide type or benzimidazolylacetate type coupler residues; coupler residues derived from hetero ring-substituted acetamides or hetero ring-substituted acetates described in U.S. Pat. No. 3,841,880; coupler residues derived from acylacetamides described in U.S. Pat. No. 3,770,446, British Patent No. 1,459,171, West German Patent Application (OLS) No. 2,503,099, Japanese Patent Application (OPI) No. 139738/75 or Research Disclosure, 15737; and heterocyclic couplers described in U.S. Pat. No. 4,046,574.

As a magenta color image-forming coupler residue represented by Y, coupler residues containing a 5-oxo-2-pyrazoline nucleus, a pyrazolo(1,5-a)benzimidazole nucleus or a cyanoacetophenone type coupler residue are preferable.

As a cyan color image-forming coupler residue represented by Y, coupler residues containing a phenol nucleus or an alpha-naphthol nucleus are preferable.

Further, those coupler residues which form substantially no dyes after coupling with an oxidation product of a developing agent can exert the same effect in terms of the effect of a DIR coupler. As this type of coupler residue represented by Y, there are illustrated those coupler residues which are described in U.S. Pat. Nos. 4,052,213, 4,088,491, 3,632,345, 3,958,993 and 3,961,959.

As the essential moiety of the development inhibitor represented by Y, there are illustrated a divalent heterocyclic group or heterocyclic thio group. Examples thereof are shown below together with the position at which they are substituted by groups $J—(L_1)_a—$ and $—(L_2—Z)_b$.

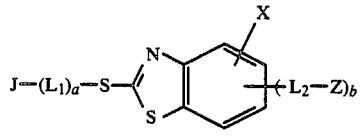

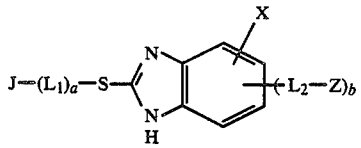

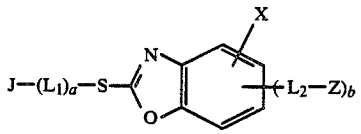

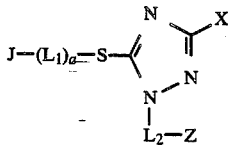

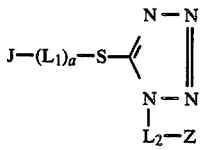

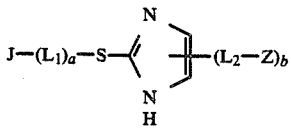

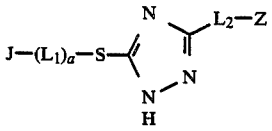

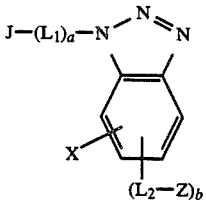

-continued

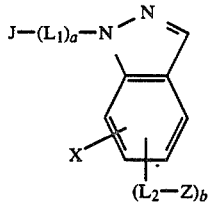

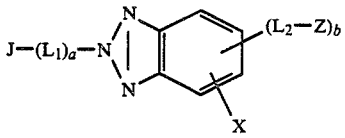

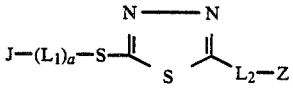

In the above-illustrated formulae, the substituent represented by X (in the general formula (VII), included in the Y moiety) represents a hydrogen atom, a halogen atom, an alkyl group, an alkenyl group, an alkanamido group, an alkeneamido group, an alkoxy group, a sulfonamido group or an allyl group.

Examples of the group represented by Z in the general formula (VII) include an alkyl group, an alkenyl group, an aryl group, an aralkyl group, and a heterocyclic group.

Examples of the linking group represented by $L_1$ in the general formula (VII) are shown below together with J and $Y—(L_2—Z)_b$.

| | |
|---|---|
| $J—OCH_2—Y—(L_2—Z)_b$ | (linking group described in U.S. Pat. No. 4,146,396) |
| $J—SCH_2—Y—(L_2—Z)_b$ | |
| $J—O—\overset{O}{\overset{\|\|}{C}}—Y—(L_2—Z)_b$ | (linking group described in West German Patent Application (OLS) No. 2,626,315) |
| 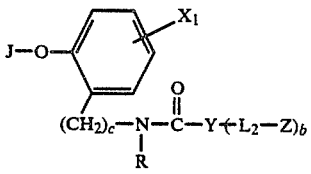 | (linking group described in U.S. Pat. No. 4,248,962; wherein R represents a hydrogen atom, an alkyl group having 1 to 4 carbon atoms, or an aryl group having 6 to 10 carbon atoms; $X_1$ represents a hydrogen atom, a halogen atom, a cyano group, a nitro group, an alkyl group having 1 to 10 carbon atoms, or a group represented by $—OR_4$, $—COOR_4$, $—CONHR_4$, $—NHCOR_4$, $—NHSO_2R_4$, $—SO_2NHR_4$ or $—SO_2R_4$ wherein $R_4$ represents an alkyl group having 1 to 20 carbon atoms or an aryl group having 6 to 20 carbon atoms; and c represents an integer of 0 to 2). |

With these DIR couplers (represented by the general formula (VII) wherein a=1), the seceding group to be released after the reaction with an oxidation product of a developing agent is immediately decomposed to release a development inhibitor ($H—Y—(L_2—Z)_b$).

In the linking group represented by $L_2$ in the general formula (VII) is contained a chemical bond that is to be split in a developer. Examples of such chemical bond are illustrated in the following. These bonds are split with a nucleophilic agent such as a hydroxy ion or a hydroxylamine contained in a color developer.

| Chemical Bond contained in $L_2$ | Splitting reaction of left bond (reaction with OH) |
|---|---|
| —COO— | —COOH + HO— |
| —NH(H)COO— | —$NH_2$ + HO— |
| —$SO_2O$— | —$SO_3H$ + HO— |
| —$OCH_2CH_2SO_2$— | —OH + $CH_2$=$CHSO_2$— |
| —OC(=O)— | —OH + HO— |
| —NHC(=O)C(=O)— | —$NH_2$ + HO— |

One of each of the chemical bonds shown in the above is bound to Y directly or through an alkylene group and/or a phenylene group, and the other directly to Z. Where the bond is bound to Y through an alkylene group or a phenylene group, the divalent alkylene or phenylene group may contain an ether bond, an amido bond, a carbonyl group, a thioether bond, a sulfon group, a sulfonamido bond or an urea bond.

Preferable examples of the linking group represented by $L_2$ are illustrated below together with the positions at which Y and Z substitute.

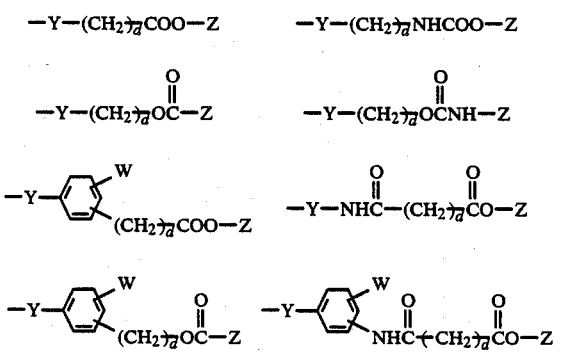

In the above formulae, d represents an integer of 0 to 10, preferably 0 to 5. W is selected from among a hydrogen atom, a halogen atom, an alkyl group containing 1 to 10, preferably 1 to 5, carbon atoms, an alkanamido group containing 1 to 10, preferably 1 to 5, carbon atoms, an alkoxy group containing 1 to 10, preferably 1 to 5, carbon atoms, an alkoxycarbonyl group containing 1 to 10, preferably 1 to 5, carbon atoms, an aryloxycarbonyl group, an alkanesulfonamido group containing 1 to 10, preferably 1 to 5, carbon atoms, an aryl group, a carbamoyl group, an N-alkylcarbamoyl group containing 1 to 10, preferably 1 to 5, carbon atoms, a nitro group, a cyano group, an arylsulfonamido group, a sulfamoyl group, and an imido group.

Of the compounds represented by the general formula (VII), those represented by the following general formulae (VIII), (IX), and (X) are preferable. These couplers show a strong development-inhibiting effect immediately after elimination of the coupling-off group.

General formula (VIII)

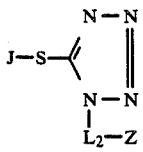

General formula (IX)

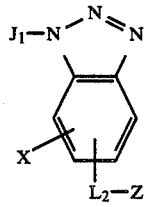

General formula (X)

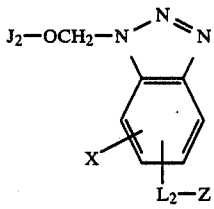

J, $L_2$, and Y in the general formula (VIII) are the same as defined with respect to the general formula (VII).

$J_1$ in the general formula (IX) represents a coupler residue of J other than a cyan coupler residue mentioned with respect to the general formula (I).

$J_2$ in the general formula (X) represents a cyan coupler residue of J mentioned with respect to the general formula (I).

X, $L_2$, and Z in the general formula (IX) and (X) are the same as defined with respect to the general formula (VII).

It is those compounds which are represented by the general formulae (V) to (XI) described in U.S. Pat. No. 4,477,563 that exhibit remarkable effects when applied to the present invention. Preferable specific compounds are Compounds (1) to (41) described in the above-described specification. The first six examples of these compounds are reproduced below.

(1)
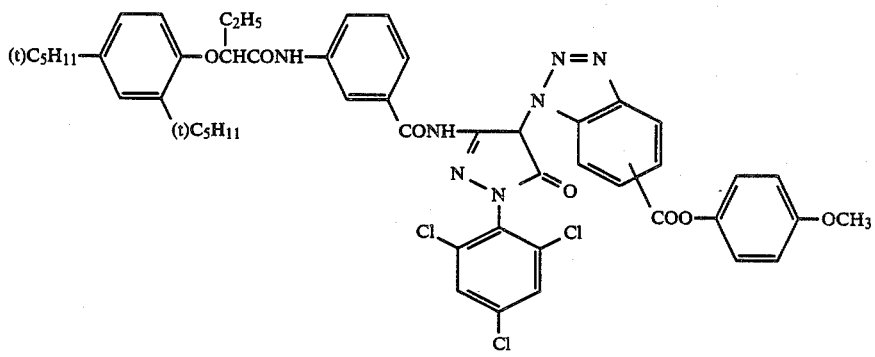
(2)
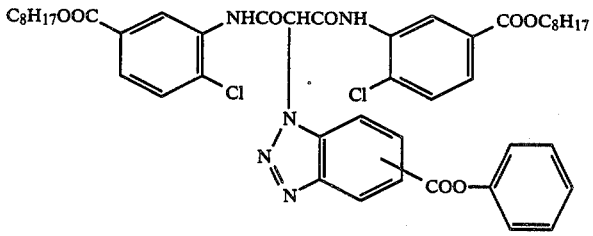
(3)
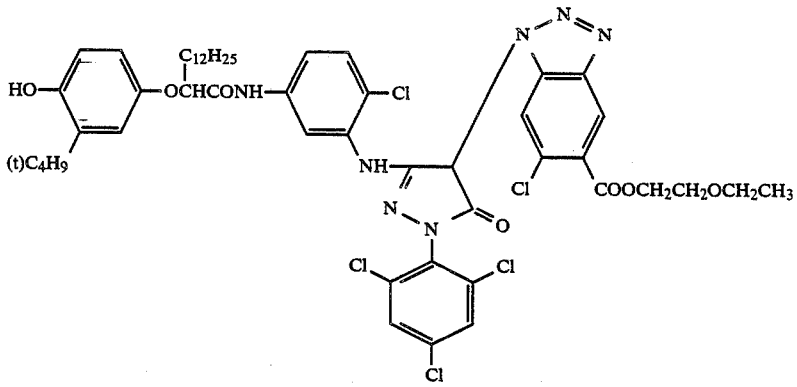
(4)
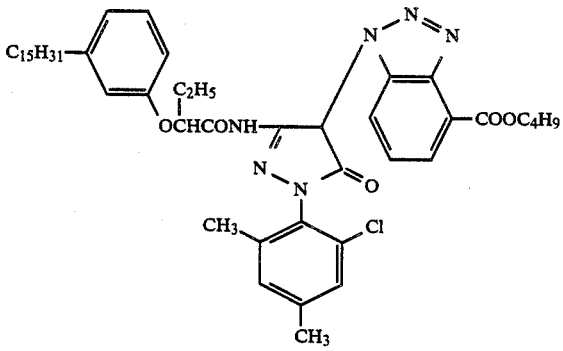

-continued (5)

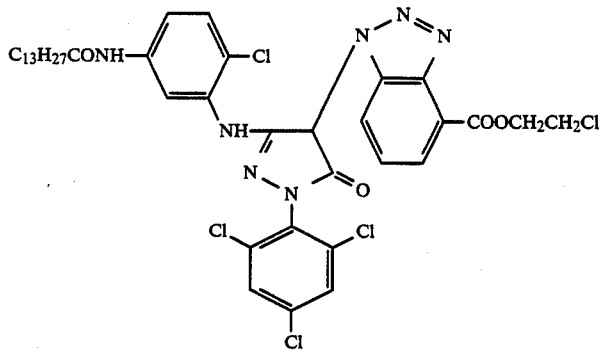

(6)

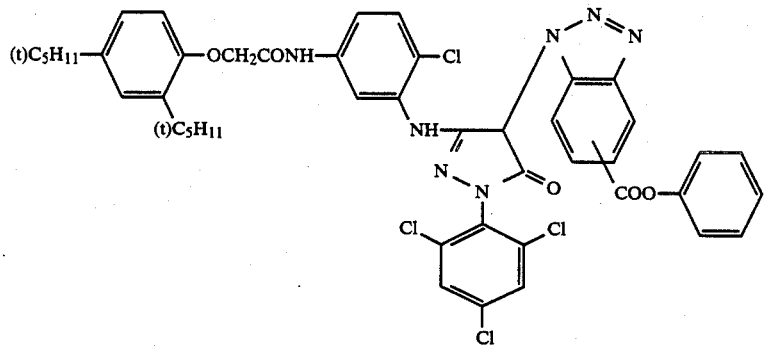

Cyan image-forming couplers of the present invention (hereinafter referred to as cyan couplers) include oil protection type naphtholic and phenolic couplers. Typical examples thereof include naphtholic couplers described in U.S. Pat. No. 2,474,293, preferably oxygen atom seceding type 2-equivalent naphtholic couplers described in U.S. Pat. Nos. 4,052,212, 4,146,396, 4,228,233, and 4,296,200. Specific examples of the phenolic couplers are described in U.S. Pat. Nos. 2,369,929, 2,801,171, 2,772,162, 2,895,826, etc. Cyan couplers fast against high humidity and high temperature are preferably used in the present invention, and typical examples thereof include phenolic cyan couplers having an alkyl group having 2 or more carbon atoms at the m-position of the phenol nucleus as described in U.S. Pat. No. 3,772,002; 2,5-diacylamino-substituted phenolic couplers described in U.S. Pat. Nos. 2,772,162, 3,758,308, 4,126,396, 4,334,011, 4,327,173, West German Patent Application (OLS) No. 3,329,729, and Japanese Patent Application No. 42671/83; and phenolic couplers having a phenylureido group in the 2-position and an acylamino group in the 5-position, as described in U.S. Pat. Nos. 3,446,622, 4,333,999, 4,451,559, and 4,427,767, etc.

These cyan couplers may be used not only in the same layer of the DIR compound but in a red-sensitive layer as well.

Typical examples of yellow couplers to be used in the present invention include oil protection type acylacetamide couplers. Specific examples thereof are described in U.S. Pat. Nos. 2,407,210, 2,875,057, 3,265,506, etc. In the present invention, the use of a two-equivalent yellow coupler is preferable, and typical examples thereof include yellow couplers of oxygen atom seceding type described in U.S. Pat. Nos. 3,408,194, 3,447,928, 3,933,501, and 4,022,620 and yellow couplers of nitrogen atom seceding type described in Japanese Patent Publication No. 10739/83, U.S. Pat. Nos. 4,401,752 and 4,326,024, RD 18053 (April, 1979), British Pat. No. 1,425,020, West German Patent Application (OLS) Nos. 2,219,917, 2,261,361, 2,329,587, 2,433,812, etc. Alpha-pivaloylacetanilide type couplers are excellent in fastness, particularly light fastness, of colored dyes, whereas alpha-benzoylacetanilide type couplers provide high coloration density.

Magenta couplers to be used in the present invention include oil protection type indazolone or cyanoacetyl couplers, preferably, pyrazolotriazole couplers such as 5-pyrazolone and pyrazoloazole couplers. Of the 5-pyrazolone couplers, those which are substituted by an arylamino group or an acylamino group in the 3-position are preferable in view of hue and coloration density of colored dyes. Typical examples thereof are described in U.S. Pat. Nos. 2,311,082, 2,343,703, 2,600,788, 2,908,573, 3,062,653, 3,152,896, 3,936,015, etc. As releasing groups of 2-equivalent 5-pyrazolone couplers, nitrogen atom seceding groups described in U.S. Pat. No. 4,310,619 and arylthio groups described in U.S. Pat. No. 4,351,897 are particularly preferable. Ballast group-having 5-pyrazolone couplers described in European Pat. No. 73,636 provide high coloration density.

As pyrazoloazole type couplers, there are illustrated pyrazolobenzimidazoles described in U.S. Pat. No. 3,369,879, preferably pyrazolo(5,1-c)(1,2,4)triazoles described in U.S. Pat. No. 3,725,067, pyrazolotetrazoles described in Research Disclosure, 24220 (June, 1984), and pyrazolopyrazoles described in Research Disclosure, 24230 (June, 1984). Imidazo(1,2-b)pyrazoles described in European Pat. No. 119,741 are preferable in view of little yellow side absorption and the light fastness of formed dyes, and pyrazolo(1,5-b)(1,2,4)triazoles described in European Pat. No. 119,860 are particularly preferable.

In order to eliminate unnecessary absorption in a shorter wavelength region of dyes formed from magenta and cyan couplers, colored couplers are preferably used in color light-sensitive materials for photographing use. Typical examples thereof include yellow colored magenta couplers described in U.S. Pat. No. 4,163,670, Japanese Patent Publication No. 39414/82, etc. and magenta colored cyan couplers described in U.S. Pat. Nos. 4,004,929 and 4,138,258, British Pat. No. 1,146,368, etc.

Graininess can be improved by using those couplers which form dyes with proper diffusibility. As such blurring couplers, U.S. Pat. No. 4,366,237 and British Pat. No. 2,125,570 describe specific examples of magenta couplers, and European Pat. No. 96,570 and West German Patent Application (OLS) No. 3,234,533 describe specific examples of yellow, magenta and cyan couplers.

The dye-forming couplers and the above-mentioned special couplers may be in a dimer or more polymerized form. Typical examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

Two or more of the various couplers to be used in the present invention may be used in one and the same light-sensitive layer, or one and the same compound may be used in two or more layers for obtaining photographic characteristics required for light-sensitive materials.

The couplers and the DIR compounds to be used in the present invention may be introduced into a light-sensitive material according to various known dispersing methods. For example, there are typical examples of a solid dispersion method, an alkali dispersion method, preferably a latex dispersion method, more preferably an oil-in-water dispersion method. In the oil-in-water dispersion method, the compounds are dissolved in a single liquid of a high-boiling organic solvent having a boiling point of 175° C. or above or a low-boiling, so-called auxiliary solvent, or in a mixed solvent of the two, then finely dispersed in water or an aqueous medium such as a gelatin aqueous solution in the presence of a surfactant. Examples of the high-boiling organic solvent are described in U.S. Pat. No. 2,322,027, etc. The dispersion may be accompanied by phase inversion. If necessary, the auxiliary solvent may be removed or reduced in amount from the dispersion before coating, by distillation, noodle-washing with water, ultrafiltration, or the like.

Specific examples of the high-boiling organic solvent include phthalic esters (e.g., dibutyl phthalate, dicyclohexyl phthalate, di-2-ethylhexyl phthalate, decyl phthalate, etc.), esters of phosphoric acid or phosphonic acid (e.g., triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, etc.), benzoic acid esters (e.g., 2-ethylhexyl benzoate, dodecyl benzoate, 2-ethylhexyl p-hydroxybenzoate, etc.), amides (e.g., diethyldodecanamide, N-tetradecylpyrrolidone, etc.), alcohols or phenols (e.g., isostearyl alcohol, 2,4-di-tert-amylphenol, etc.) aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), and the like. As the auxiliary solvents, organic solvents having a boiling point of about 30° C.. or above, preferably 50° C. to about 160° C., can be used. Typical examples thereof include ethyl acetate, butyl acetate, ethyl propionate, methyl ethyl ketone, cyclohexanone, 2-ethoxyethyl acetate, dimethylformamide, etc.

Specific examples of the step and effect of the latex dispersion method and latex for impregnation are described in U.S. Pat. No. 4,199,363 and West German Patent Application (OLS) Nos. 2,541,274 and 2,541,230.

The cyan couplers of the present invention to be contained in a blue-sensitive layer are used in an amount of $2\times10^{-3}$ mol to $5\times10^{-1}$ mol, preferably $1\times10^{-2}$ to $5\times10^{-1}$ mol, per mol of silver halide.

The DIR couplers of the present invention to be incorporated in a blue-sensitive layer are used in an amount of $1\times10^{-3}$ mol to $5\times10^{-1}$ mol, preferably $3\times10^{-3}$ mol to $1\times10^{-1}$ mol, per mol of silver halide.

In the present invention, the cyan image-forming coupler and the compound capable of releasing a highly diffusible development inhibitor or the like may be the same compound or may be different compounds. That is, DIR cyan couplers can perform the two functions.

A standard amount of the dye image-forming color coupler ranges from 0.001 to 1 mol per mol of light-sensitive silver halide, preferably 0.01 to 0.5 mol with yellow coupler, 0.003 to 0.3 mol with magenta coupler, and 0.002 to 0.3 mol with cyan coupler in the red sensitive layer.

In photographic emulsion layers of the photographic light-sensitive material to be used in the present invention, any of silver bromide, silver bromoiodide, silver chlorobromoiodide, silver chlorobromide, and silver chloride may be used, with silver bromoiodide or silver chlorobromoiodide containing 30 mol% or less of silver iodide being preferable. Silver bromoiodide containing silver iodide in an amount of 2 mol% to 25 mol% is particularly preferable.

Silver halide grains in the photographic emulsion are not particularly limited as to the form thereof, and may be so-called regular grains having regular crystal form such as cube, octahedron and tetradecahedron, irregular grains having spherical or like form, grains having crystal defect, or a mixed form thereof.

Silver halide grains may be fine grains having a grain size of 0.1μ or less or large grains having a grain size of up to 10μ in terms of projected area diameter, and may be a mono-disperse emulsion having a narrow distribution or a poly-disperse emulsion having a broad distribution.

The photographic emulsion to be used in the present invention may be prepared according to processes described in P. Glafkides, "Chimie et Physique Photographique", published by Paul Montel, 1967; G. F. Duffin, "Photographic Emulsion Chemistry" (published by Focal Press, 1966), V. L. Zelikman et al; "Making and Coating Photographic Emulsion" (published by Focal Press, 1964), etc. That is, any of an acidic process, a neutral process, and an ammoniacal process can be used. As a manner of reacting a soluble silver salt with a soluble halide salt, any of single-jet and double-jet method, and their combination may be employed. A process of forming grains in the presence of excess silver ion (called reverse-jet method) can be employed as well. As one type of the double-jet method, a process called controlled double-jet method wherein pAg in a liquid phase in which silver halide is formed is kept constant can be employed. This process provides a silver halide emulsion containing silver halide grains having approximately uniform particle size.

Two or more silver halide emulsions having been separately prepared may be mixed for use.

In addition, platy grains having an aspect ratio of 5 or more are also usable in the present invention. Platy grains can be easily prepared according to the processes described in Cleve, "Photography Theory and Practice", p. 131; Gutoff, "Photographic Science and Engineering", vol. 14, pp. 248–257 (1970); U.S. Pat. Nos. 4,434,226, 4,414,310, 4,433,048; British Pat. No. 2,112,157; etc. The platy grains have such advantages as that they possess increased covering properties, and that they can be color-sensitized more effectively with sensitizing dyes, which is described in detail in the above-cited U.S. Pat. No. 4,434,226.

The crystal structure may be uniform or may be different in silver halide composition between the inner portion and the outer portion thereof, or may be a layered structure. Such emulsion grains are described in British Pat. No. 1,027,146, U.S. Pat. Nos. 3,505,068, 4,444,877, and Japanese Patent Application No. 248469/83. Also, silver halide crystals different from each other in composition may be combined by epitaxial conjunction, or may be combined with other compounds than silver halide, such as silver rhodanate, lead oxide, etc. Such emulsion grains are described in U.S. Pat. Nos. 4,094,684, 4,142,900, 4,459,353, British Pat. No. 2,038,792, U.S. Pat. Nos. 4,349,622, 4,395,478, 4,433,501, 4,463,087, 3,656,962, 3,852,067, Japanese Patent Application (OPI) No. 162540/84, etc.

The photographic emulsion to be used in the present invention may be spectrally sensitized with known photographic-sensitizing dyes. In addition, known antifoggants or stabilizers may be used for the purpose of preventing fogging or stabilizing photographic properties during preparation, storage or photographic processing of light-sensitive materials. Specific examples thereof and the manner of using them are described, for example, in U.S. Pat. Nos. 3,954,474, 3,982,947, Japanese Patent Publication No. 28660/77, Research Disclosure 17643 (Dec., 1978), VIA to VIM, and E. J. Birr, "Stabilization of Photographic Silver Halide Emulsions" (Focal Press, 1974), etc.

The light-sensitive material to be prepared according to the present invention may contain, as color fogging-preventing agents or color contamination-preventing agents, hydroquinones, aminophenols, sulfonamidophenols, etc. The light-sensitive material of the present invention may include various anti-fading agents, and there are illustrated organic anti-fading agents such as 5-hydroxycoumaranes, spirochromans, etc. and metal complex type anti-fading agents such as bis(N,N-dialkyldithiocarbamato)nickel complex.

An ultraviolet ray absorbent such as benzotriazoles may be used in the light-sensitive material of the present invention. Typical examples thereof are described in Research Disclosure, 24239 (June, 1984), etc. Further, the light-sensitive material of the present invention may contain in its hydrophilic colloidal layer filter dyes or water-soluble dyes for preventing irradiation or halation or for other purposes.

As binders for the photographic light-sensitive layers or a backing layer to be used in the present invention, gelatin, modified gelatin, synthetic hydrophilic polymers, etc. can be used. Hardeners such as vinylsulfone derivatives may be incorporated in any hydrophilic colloidal layer. Further, vinyl polymers containing a sulfinic acid salt in the side chain may be used as a hardening accelerating agent.

The light-sensitive material of the present invention may contain one or more surfactants for various purposes such as improvement of coating properties, antistatic properties, slipping properties, emulsion dispersibility, anti-adhesion properties, and photographic properties (for example, development acceleration, realization of contrasty tone, sensitization, etc.).

In addition to the above-described additives, the light sensitive material of the present invention may contain various stabilizers, stain-preventing agents, developing agents or precursors thereof, development accelerators or precursors thereof, lubricants, mordants, matting agents, antistatic agents, plasticizers or other additives useful for photographic light-sensitive materials. Typical examples of these additives are described in Research Disclosure, 17643 (Dec., 1978) and ibid., 18716 (Nov., 1979).

The present invention is preferably applied to high-speed color films for photographing which have on a support at least two emulsions having the same color sensitivity but being different from each other in the degree of sensitivity. Layers are typically arranged in the order of a red-sensitive layer, a green-sensitive layer, and a blue-sensitive layer from the support side. However, a reverse order wherein a high-speed layer is sandwiched between emulsion layers having different color sensitivities may also be employed.

After being processed with a developer containing an aromatic primary amine color-developing agent, the light-sensitive material of the present invention is subjected to bleaching and fixing, bleach-fixing, or a combination thereof for removing developed silver. In this situation, bleaching accelerators such as iodide ion, thioureas, thiol compounds, etc. may optionally be used. After bleach-fixing or fixing, water-washing is often conducted. This water-washing step is conveniently conducted by counter current washing using two or more baths to save water. Also, a multi-stage counter current stabilize-processing step as described in Japanese Patent Application (OPI) No. 8543/82 may be conducted. In this step, pH-adjusting buffers or formalin may be added, with ammonium salts being preferable additives.

In silver halide color photographic light-sensitive materials, dyes to be obtained by color development are usually so selected that they present a complementary color of the color region to which the silver halide light-sensitive layer is sensitive. Japanese Patent Application (OPI) No. 2537/75 discloses that, in special cases, part of the added couplers are not designed to form a color complementary to the color of the spectrally sensitized region of the layer containing them. That is, with Icc uncolored couplers (DIR couplers for correcting interlayer color) described in Japanese Patent Application (OPI) No. 2537/75, dye images formed by coupling of the couplers are not necessarily complementary to the color of the spectrally sensitized region of the layer containing them. For example, yellow-forming Icc uncolored couplers are used in green-sensitive emulsion layers. However, development inhibitors released from the Icc uncolored couplers remain in the processing solution to exert detrimental influences on photographic properties, though they have a large diffusibility, aand hence they involve disadvantages upon practical use.

On the other hand, Japanese Patent Application (OPI) No. 151944/82 discloses DIR compounds which, upon coupling with an oxidation product of a developing agent, release a development inhibitor or a precursor thereof which is decomposed, after diffusing into the color developer, into a compound exerting substantially no influences.

Therefore, the use of the DIR compound as disclosed in U.S. Pat. No. 4,477,563 in each emulsion layer for raising contrast of 10 lines/mm fine lines on a film utilizing horizontal Everhard effect leads to reproduction of non-preferable colors though single color with a high saturation can be reproduced. Particularly, discrimination between yellow and yellowish green becomes difficult. It is absolutely unexpected that the above-described problem can be solved by incorporating a cyan coupler in at least one of the blue-sensitive layers as disclosed in the present invention.

The inventors have also discovered that the sharpness of cyan color can be improved by incorporating a cyan coupler in at least one of the blue-sensitive layers.

As a technique for providing a color photographic light-sensitive material excellent in sharpness and color reproducibility, European Patent Application No. 0,167,173A discloses the technique of making a weight-average wavelength ($\lambda_G$) of spectral sensitivity distribution of a green-sensitive layer to fall within the range of 520 nm$\leqq\lambda_G\leqq$580 nm, and making a weight-average wavelength of wavelength distribution of interlayer effect to be exerted onto at least one cyan color-forming red-sensitive silver halide emulsion layer from other layers in the range of 500 nm to 600 nm ($\lambda_{-R}$) to fall within the range of 500 nm $<\lambda_{-R}\leqq$560 nm, with $\lambda_G-\lambda_{-R}\geqq$5 nm. This technique enables raising saturation of red color and reproducing color, with various greens (e.g., yellowish green, orange-tinted green, cyan-tinted green, greenish brown, etc.) being excellently discriminated.

When the present invention, which provides a color photographic light-sensitive material capable of clearly discriminating yellow color and yellowish green from each other and providing highly saturated green color, is combined with the technique disclosed in the above-described European Patent Application No. 0,167,173A, the light-sensitive material of the present invention can further acquire the properties of providing highly saturated red and excellent color reproducibility of various greens being clearly discriminated from each other.

The present invention is characterized in that deterioration of color reproducibility, which has been the problem with prior art techniques of improving sharpness by adding to silver halide emulsion layers couplers capable of producing a highly diffusible development inhibitor or a precursor thereof, can be removed while keeping the above-described effect of improving sharpness. When the present invention is practiced in a color light-sensitive material using a coupler capable of releasing an inhibitor whose inhibiting effect decreases with the reaction in an alkaline developing bath, as described in U.S. Pat. No. 4,477,563, there results improved yellow sharpness, highly saturated green, and well discriminated yellowish green. The effects of the present invention are more enhanced in color light-sensitive materials having such spectral sensitivities as described in European Patent Application No. 0,167,173A.

The present invention is now illustrated in greater detail by reference to the following examples which, however, are not to be construed as limiting the present invention in any way.

Unless otherwise specified, all ratios, percentages, etc. are by weight.

EXAMPLE 1

Multi-layer color light-sensitive material 101 comprising a transparent cellulose triacetate film support having provided thereon the following layers was prepared. Samples 102 and 103 were prepared by partly changing the formulation of Sample 101. These three samples were used as comparative samples. After preparing Samples 104 and 105 in accordance with the present invention, they were subjected to the comparing tests described hereinafter.

(Composition of light-sensitive layer)

Coated amounts of silver halide and colloidal silver are presented in terms of g/m$^2$ unit of silver, coated amounts of couplers, additives, and gelatin are presented by terms of g/m$^2$ unit, and coated amounts of sensitizing dyes are presented in terms of mol number per mol of silver halide in the same layer.

Sample 101 (for comparison)

| | |
|---|---|
| 1st layer: Antihalation layer | |
| A gelatin layer containing: | |
| Black colloidal silver | 0.15 |
| UV ray absorbent, U-1 | 0.08 |
| UV ray absorbent, U-2 | 0.12 |
| 2nd layer: Interlayer | |
| A gelatin layer containing: | |
| 2,5-Di-t-pentadecylhydroquinone | 0.18 |
| Coupler C-1 | 0.11 |
| 3rd layer: First red-sensitive emulsion layer | |
| A gelatin layer containing: | |
| AgBrI (AgI: 3.5 mol %; mean grain size: 0.35μ) | 1.1 |
| Sensitizing dye I | $1.4\times10^{-4}$ |
| Sensitizing dye II | $0.4\times10^{-4}$ |
| Sensitizing dye III | $5.6\times10^{-4}$ |
| Sensitizing dye IV | $4.0\times10^{-4}$ |
| Coupler C-2 | 0.4 |
| Coupler C-3 | 0.035 |
| Coupler C-4 | 0.025 |
| 4th layer: Second red-sensitive emulsion layer | |
| A gelatin layer containing: | |
| AgBrI (AgI: 7.5 mol %; mean grain size: 0.75μ) | 1.0 |
| Sensitizing dye I | $5.2\times10^{-5}$ |
| Sensitizing dye II | $1.5\times10^{-5}$ |
| Sensitizing dye III | $2.1\times10^{-4}$ |
| Sensitizing dye IV | $1.5\times10^{-5}$ |
| Coupler C-2 | 0.050 |
| Coupler C-5 | 0.070 |
| Coupler C-3 | 0.035 |
| 5th layer: Interlayer | |
| A gelatin layer containing: | |
| 2,5-Di-t-pentadecylhydroquinone | 0.08 |
| 6th layer: First green-sensitive emulsion layer | |
| A gelatin layer containing: | |
| AgBrI (AgI: 3.5 mol %; mean grain size: 0.35μ) | 0.72 |
| Sensitizing dye V | $4.0\times10^{-4}$ |
| Sensitizing dye VI | $3.0\times10^{-5}$ |
| Sensitizing dye VII | $1.0\times10^{-4}$ |
| Coupler C-6 | 0.41 |
| Coupler C-7 | 0.12 |
| Coupler C-8 | 0.02 |
| Coupler C-4 | 0.04 |
| 7th layer: Second green-sensitive emulsion layer | |
| A gelatin layer containing: | |
| AgBrI (AgI: 7.5 mol %; mean grain size: 0.75μ) | 0.85 |
| Sensitizing dye V | $2.7\times10^{-4}$ |
| Sensitizing dye VI | $1.8\times10^{-5}$ |
| Sensitizing dye VII | $7.5\times10^{-5}$ |
| Coupler C-6 | 0.095 |

-continued

| | |
|---|---|
| Coupler C-7 | 0.015 |
| 8th layer: Yellow filter layer | |
| A gelatin layer containing: | |
| Yellow colloidal silver | 0.08 |
| 2,5-Di-t-pentadecylhydroquinone | 0.090 |
| 9th layer: First blue-sensitive emulsion layer | |
| A gelatin layer containing: | |
| AgBrI (AgI: 4 mol %; mean grain size: 0.3μ) | 0.33 |
| Sensitizing dye VIII | $4.4 \times 10^{-4}$ |
| Coupler C-9 | 0.64 |
| 10th layer: Second blue-sensitive emulsion layer | |
| A gelatin layer containing: | |
| AgBrI (AgI: 7 mol %; mean grain size: 0.9μ) | 0.55 |
| Sensitizing dye VIII | $3.0 \times 10^{-4}$ |

-continued

| | |
|---|---|
| Coupler C-9 | 0.23 |
| 11th layer: First protective layer | |
| A gelatin layer containing: | |
| UV absorbent, U-1 | 0.14 |
| UV absorbent, U-2 | 0.22 |
| 12th layer: Second protective layer | |
| A gelatin layer containing: | |
| AgBrI (AgI: 2 mol %; mean grain size: 0.07μ) | 0.25 |
| Polymethylmethacrylate particles (diameter: 1.5μ) | 0.10 |

To each of the layers were added a gelatin hardener, H−1, and a surfactant in addition to the above-described formulations to coat.

C-1

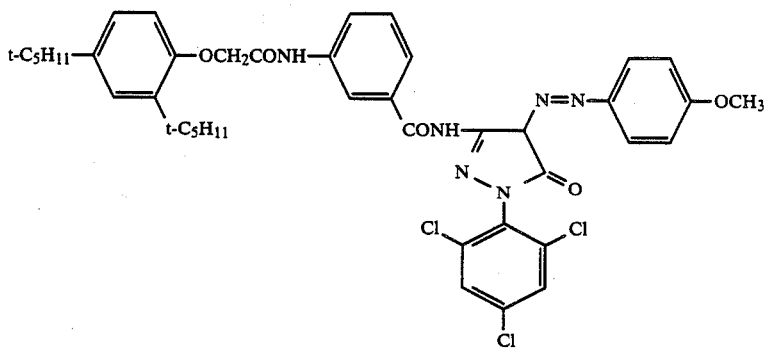

C-2

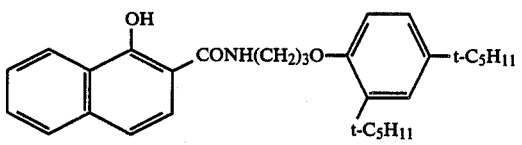

C-3

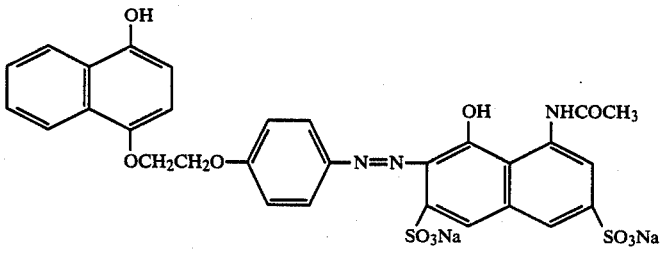

C-4

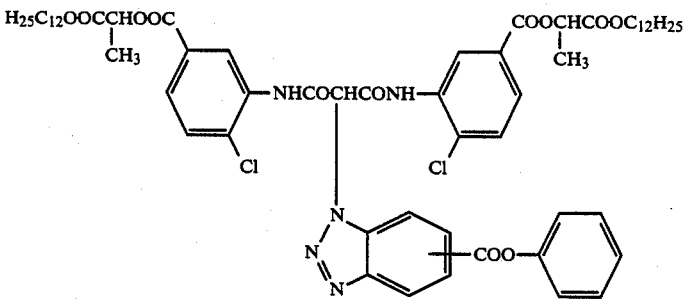

C-5

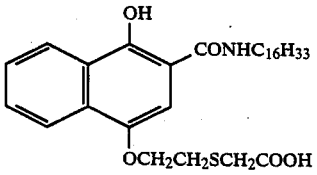

-continued
C-6
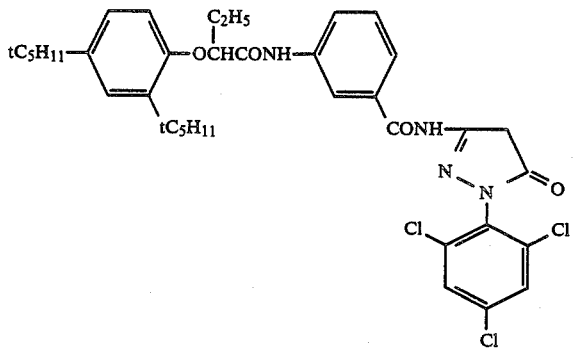
C-7
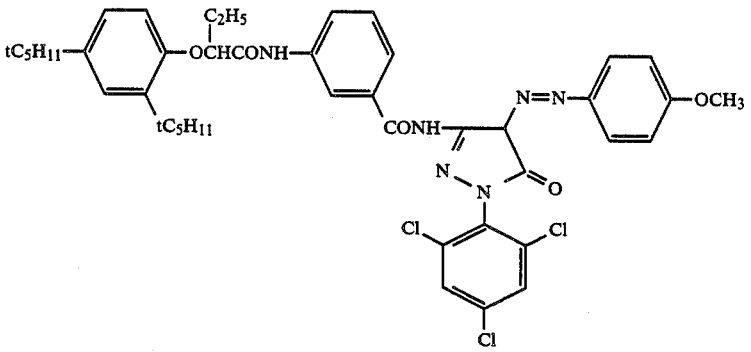
C-8
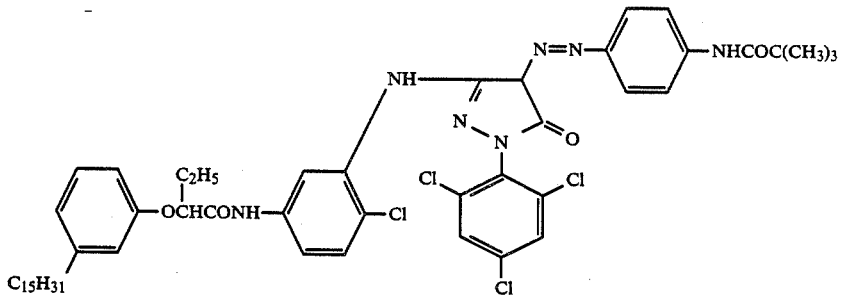
C-9
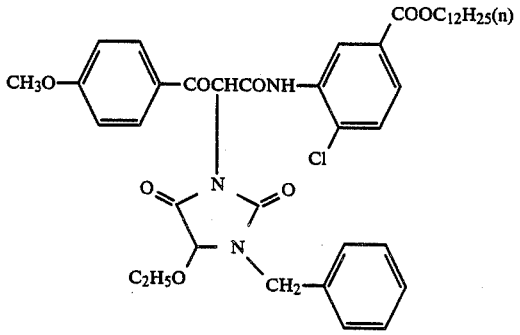

-continued
C-10
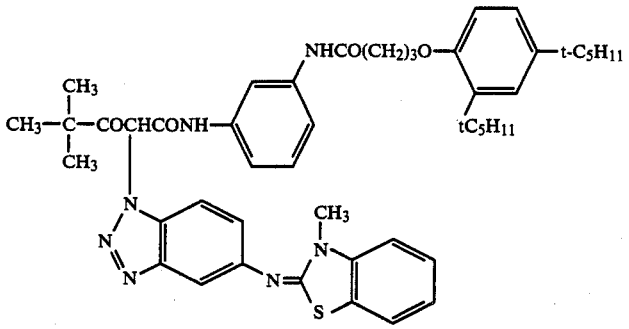
$CH_2{=}CH{-}SO_2{-}CH_2{-}CONH(CH_2)_2NHCO{-}CH{-}SO_2{-}CH{=}CH_2$ H-1
Sensitizing Dye:
I
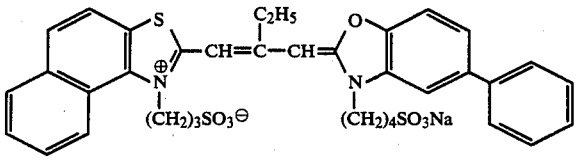
II
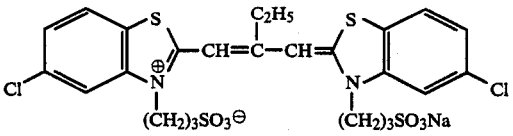
III
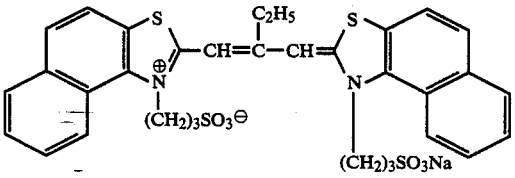
IV
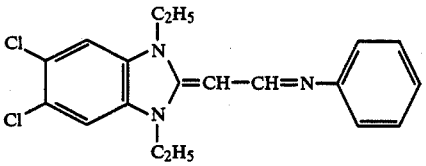
V
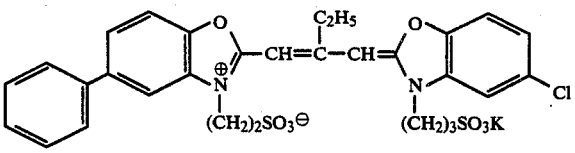
VI
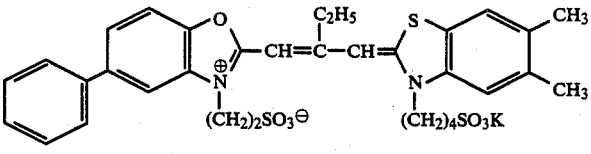
VII
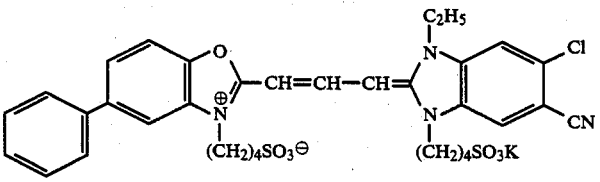

-continued

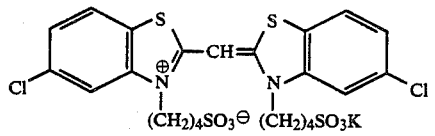

VIII

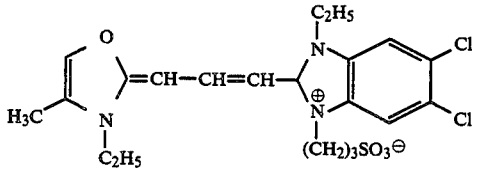

IX

Chemical structure of the compounds used in Example:

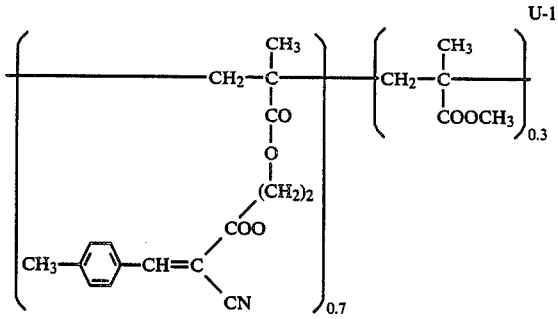

U-1

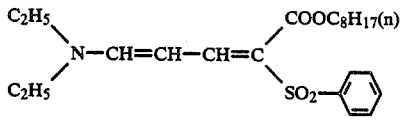

U-2

Sample 102 (for comparison)

Sample 102 was prepared by conducting the following change in Sample 101.

(1) Formulation of the 9th layer was changed to the following formulation.

| | |
|---|---|
| AgBrI (AgI: 4 mol %; mean grain size: 0.3μ) | 0.37 |
| Sensitizing dye VIII | $4.4 \times 10^{-4}$ |
| Coupler C-9 | 0.71 |
| Coupler C-10 | 0.07 |

(2) All of the coating amounts in the 6th layer were increased 1.1 times.

Sample 103 (for comparison)

Sample 103 was prepared by conducting the following changes in Sample 101.

(1) Formulation of the 9th layer was changed to the following formulation.

| | |
|---|---|
| AgBrI (AgI: 4 mol %; mean grain size: 0.3μ) | 0.37 |
| Sensitizing dye VIII | $4.4 \times 10^{-4}$ |
| Coupler C-9 | 0.71 |
| Coupler C-4 | 0.07 |

(2) All of the coating amounts used in the 6th layer were increased 1.1 times.

(3) All of the coating amounts used in the 3rd layer were increased 1.1 times.

Sample 104 (present invention)

Sample 104 was prepared by conducting the following changes in Sample 101.

(1) Formulation of the 9th layer was changed to the following formulation.

| | |
|---|---|
| AgBrI (AgI: 4 mol %; mean grain size: 0.3μ) | 0.44 |
| Sensitizing dye VIII | $4.4 \times 10^{-4}$ |
| Coupler C-9 | 0.85 |
| Coupler C-4 | 0.08 |
| Coupler C-5 | 0.1 |

(2) All of the coating amounts used in the 10th layer was increased 1.2 times.

Sample 105 (present invention)

Sample 105 was prepared by conducting the following changes in Sample 104.

(1) DIR coupler C-4 in the 6th layer was omitted.

(2) A third green-sensitive layer of the following formulation was provided between the 6th layer and the 7th layer.

| | |
|---|---|
| AgBrI (AgI: 5 mol %; mean grain size: 0.6μ) | 0.8 |
| Sensitizing dye IX | $4.5 \times 10^{-4}$ |
| Coupler C-6 | 0.18 |
| Coupler C-4 | 0.10 |

Samples 101 to 105 were wedge-exposed using white light, then subjected to color development processing.

| | |
|---|---|
| Color development | 3'15" |
| Bleaching | 6'30" |
| Washing with water | 2'10" |
| Fixing | 4'20" |
| Washing with water | 3'15" |
| Stabilizing | 1'05" |

Processing solutions used in the respective steps had the following formulations. Color developer:

| | |
|---|---|
| Diethylnetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |

-continued

| | | |
|---|---|---|
| 4-(N—Ethyl—N—β-hydroxyethylamino)-2-methylaniline sulfate | | 4.5 g |
| Water to make | | 1.0 liter |
| | pH | 10.0 |
| Bleaching solution: | | |
| Ferric ammonium ethylenediaminetetraacetate | | 100.0 g |
| Disodium ethylenediaminetetraacetate | | 10.0 g |
| Ammonium bromide | | 150.0 g |
| Ammonium nitrate | | 10.0 g |
| Water to make | | 1.0 liter |
| | pH | 6.0 |
| Fixing solution: | | |
| Disodium ethylenediaminetetraacetate | | 1.0 g |
| Sodium sulfite | | 4.0 g |
| Aqueous solution of ammonium thiosulfate (70%) | | 175.0 ml |
| Sodium bisulfite | | 4.6 g |
| Water to make | | 1.0 liter |
| | pH | 6.6 |
| Stabilizing solution: | | |
| Formalin (40%) | | 2.0 ml |
| Polyoxyethylene-p-monononylphenyl ether (average polymerization degree: about 10) | | 0.3 g |
| Water to make | | 1.0 liter |

Sensitometry of these samples revealed that these samples showed about the same sensitivity and gradation.

These samples were then cut into Leica size for photographing, and the following two color charts were photographed.

(1) Macbeth chart (2) 12 colors charts having spectral reflectivity shown in FIG. 1 and having the main wavelength peak in about 550 to 590 nm (color charts changing from orange to yellow, and to green).

After photographing, the samples were developed in the same manner as above and printed on Fuji Color Paper so as to reproduce gray color having been photographed at the same time.

Figure 2A:
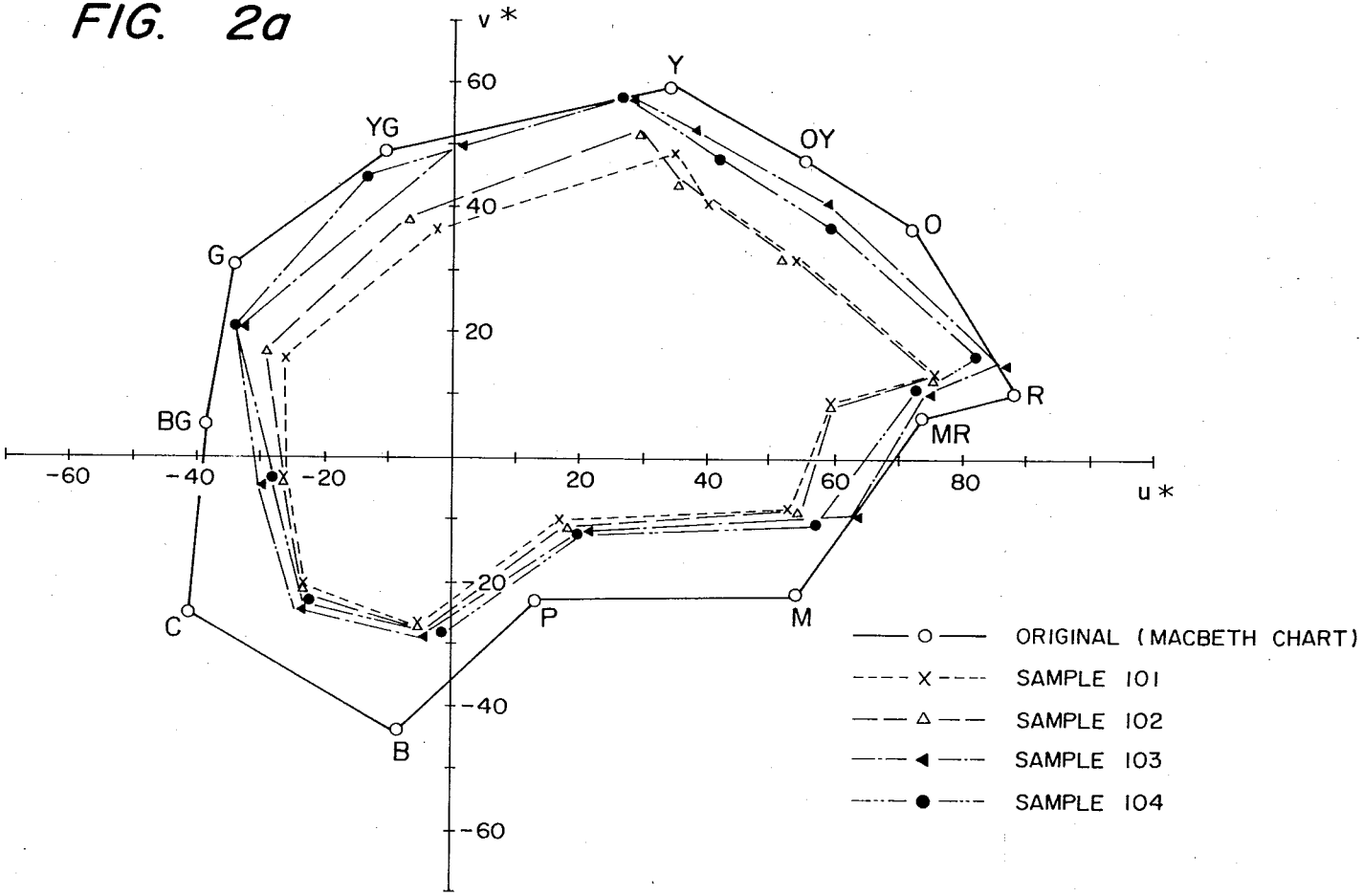
FIGS. 2*a* and 2*b* show chromaticity diagrams showing reproduced areas of resulting color prints versus the original.
Figure 2B:
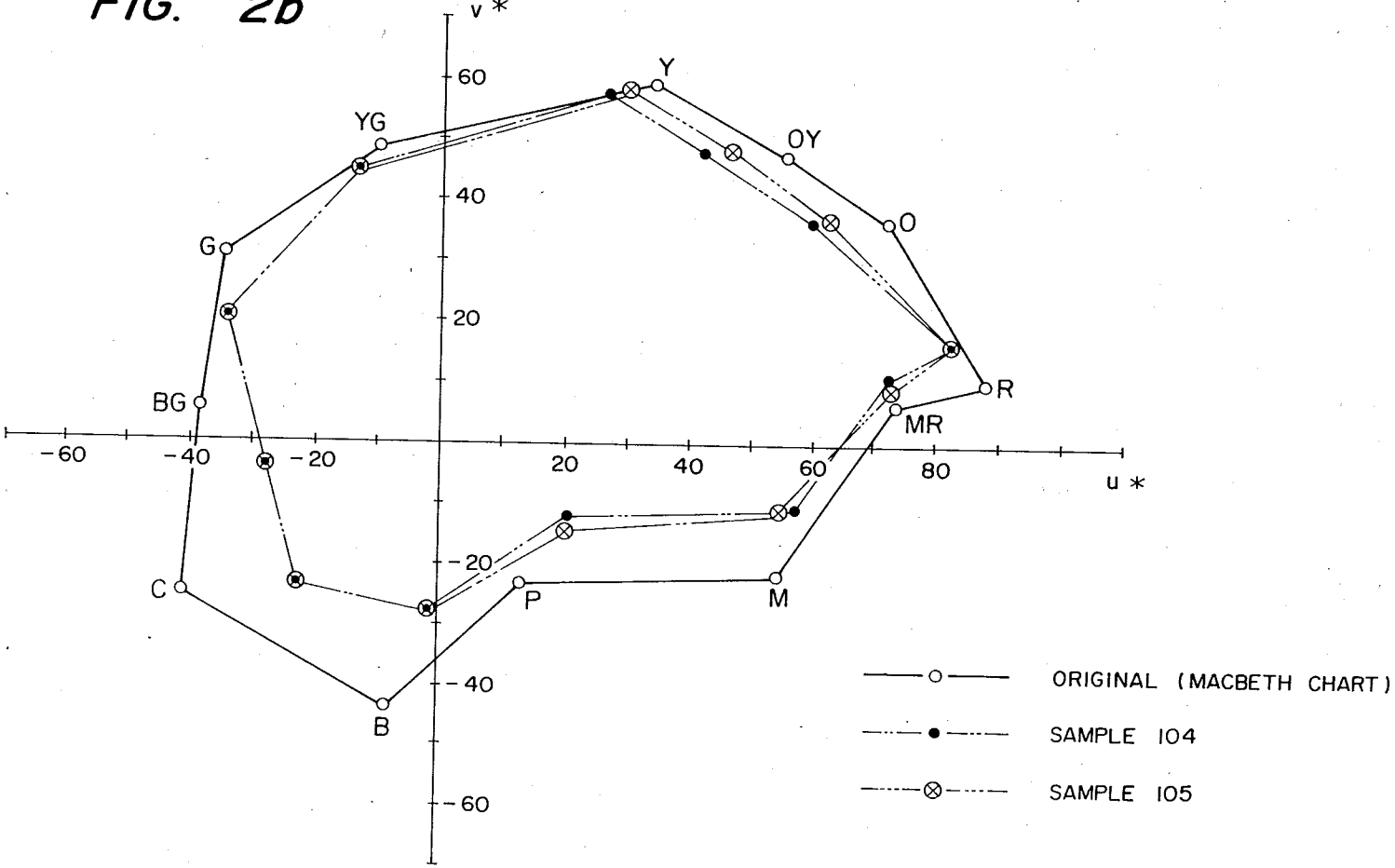

With prints (1), spectral reflectivity of each color of the Macbeth chart was measured using a color analyzer, Hitachi 307, and chromaticity points (C light source) of respective colors were plotted on U*V* chromaticity diagram based on the reflectivities measured to obtain FIGS. 2*a* and 2*b*.

Figure 3:
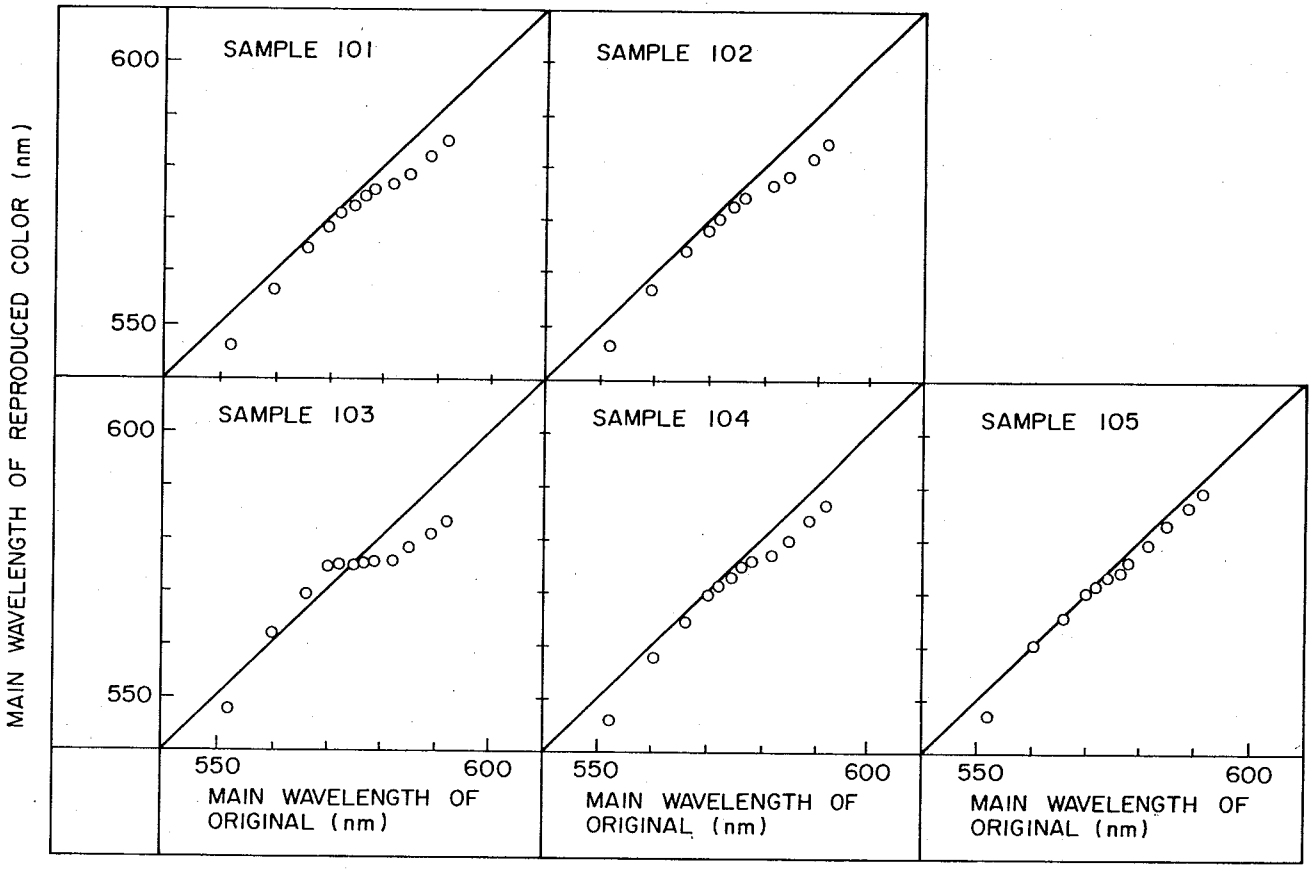
FIG. 3 shows the relation between reproduced main wavelength region versus that of the original color chart.

With prints (2), 12 color charts were analyzed by means of an SS color computer (made by Suga Electric Co., Ltd.), and the results were plotted on a 1931 CIE xy chromaticity diagram. The main wavelength of a reproduced hue was measured therefrom, and the relation to the main wavelength of the corresponding original chart is shown in FIG. 3.

FIGS. 2*a* and 2*b* show the following facts.

(1) When no DIR coupler or a DIR coupler with only low diffusibility is contained in the first blue-sensitive layer as in Samples 101 and 102, color charts with spectral reflectivity as shown in FIG. 1 are reproduced with less fidelity, particularly poor fidelity for the original color having a main wavelength of 580 nm or more, and Macbeth color chart with low saturation.

(2) When a DIR coupler with high diffusibility is contained in the first blue-sensitive layer as in Sample 103, discrimination of the color charts having a wavelength in 570 to 585 nm is extremely poor among the color charts with the spectral reflectivity shown in FIG. 1. However, saturation of green, yellow, red, etc. of the Macbeth chart is enhanced, and reproduced chromaticity points approach the original chromaticity points on the chromaticity diagram.

(3) As compared with Sample 103, Sample 104 of the present invention is about the same as Samples 101 and 102 with respect to discrimination of the color charts with the spectral reflectivity shown in FIG. 1, and shows a more highly saturated Macbeth chart than Samples 101 and 102, and furthermore shows approximately the same reproducibility as Sample 103, thus showing good reproducibility.

(4) As compared with Sample 104, Sample 105 shows yet better discriminated color charts with the spectral reflectivity of FIG. 1, and shows somewhat improved color saturation with the Macbeth chart thus showing the most improved color reproducibility.

Further, Samples 103 and 105 described above were exposed with white light through a pattern for measuring MTF, and developed in the same manner as in Example 1.

Figure 4:
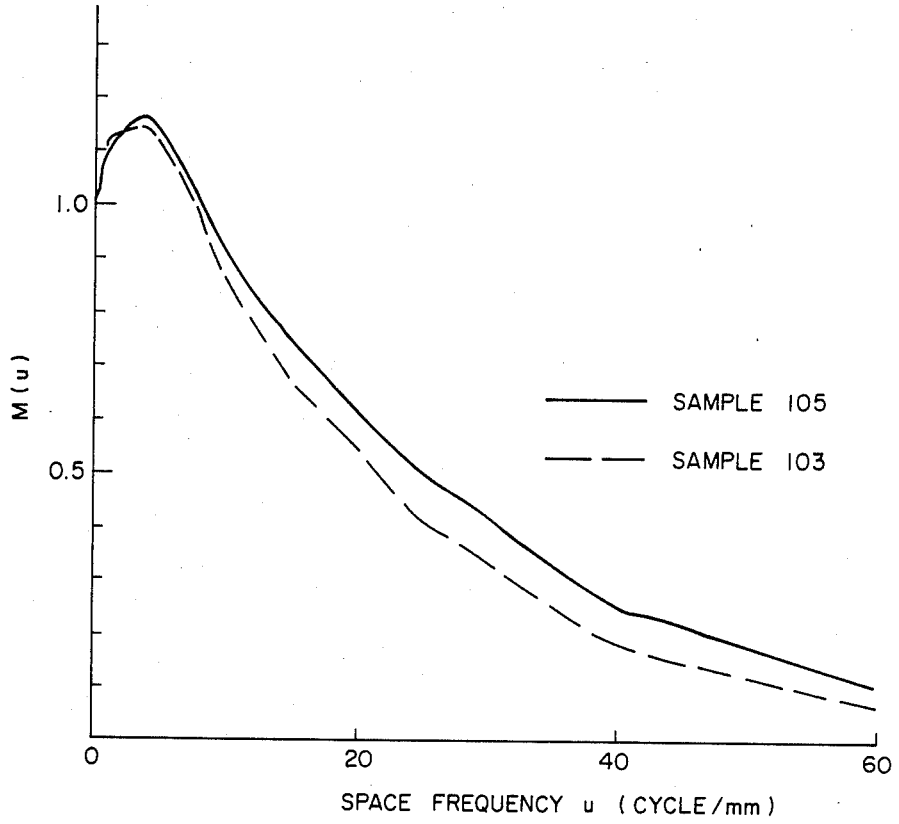
FIG. 4 shows an MTF curve for comparing sharpness.

A cyan MTF curve of the thus obtained negative film is shown in FIG. 4. It is seen that Sample 105 of the present invention shows improved sharpness.

While the invention has been described in detail and with reference to specific embodiments thereof, it will be apparent to one skilled in the art that various changes and modifications can be made therein without departing from the spirit and scope thereof.

What is claimed is:

1. A color photographic material comprising a support having provided thereon a blue-sensitive silver halide emulsion layer containing at least one coupler capable of reacting with an oxidation product of an aromatic primary amine developing agent to form a yellow dye, at least one coupler capable of reacting with said oxidation product to form a cyan dye and not to produce a diffusible development inhibitor or a precursor thereof, and at least one compound capable of reacting with said oxidation product to produce a diffusible development inhibitor or a precursor thereof, wherein the at least one coupler forming the yellow dye, the at least one coupler forming the cyan dye and the at least one compound producing a diffusible development inhibitor or a precursor thereof are present in the same blue-sensitive silver halide emulsion layer.

2. A color photographic material as in claim 1, wherein said at least one compound capable of reacting with said oxidation product to produce a diffusible development inhibitor or a precursor thereof is a DIR coupler which does not form a cyan dye.

3. A color photographic material as in claim 1, wherein said at least one coupler capable of reacting with said oxidation product to form a cyan dye is present in an amount of from $2\times10^{-3}$ to $5\times10^{-1}$ mol/mol of silver halide.

4. A color photographic material as in claim 3, wherein said at least one coupler capable of reacting with said oxidation product to form a cyan dye is present in an amount of from $1\times10^{-2}$ to $5\times10^{-1}$ mol/mol of silver halide.

5. A color photographic material as in claim 2, wherein said DIR coupler is present in an amount of from $1\times10^{-3}$ to $5\times10^{-1}$ mol/mol of silver halide.

6. A color photographic material as in claim 5, wherein said DIR coupler is present in an amount of from $3\times10^{-3}$ to $1\times10^{-1}$ mol/mol of silver halide.

7. A color photographic material as in claim 1, wherein said at least one coupler capable of reacting with said oxidation product to form a yellow dye present in an amount of from $1\times10^{-3}$ to 1 mol/mol of silver halide.

8. A color photographic material as in claim 7, wherein said at least one coupler capable of reacting with said oxidation product to form a yellow dye present in an amount of from $1\times10^{-2}$ to $5\times10^{-1}$ mol/mol of silver halide.

9. A color photographic material as in claim 1, wherein said support has provided thereon consecutively said blue-sensitive silver halide emulsion layer, a magenta coupler-containing green-sensitive silver halide emulsion layer, and a cyan coupler-containing red-sensitive silver halide emulsion layer.

10. A color photographic material as in claim 2, wherein said DIR coupler is a DIR coupler represented by formula (VII)

$$J-(L_1)_a-Y-L_2-Z)_b \quad \text{(VII)}$$

wherein J represents a coupler moiety;

Y represents an essential moiety of a compound showing development-inhibiting effect, and is bound to the coupling position of said coupler moiety directly (when a is 0) or through linking group $L_1$ (when a is 1);

Z represents a substituent bound to Y through linking group $L_2$ and capable of making the development-inhibiting effect of Y emerge;

$L_1$ represents a linking group selected from the group consisting of groups represented together with J and Y—($L_2$—Z) by the following formulae:

$$J-OCH_2-Y-(L_2-Z)_b$$
$$J-SCH_2-Y-(L_2-Z)_b$$

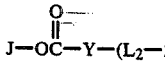

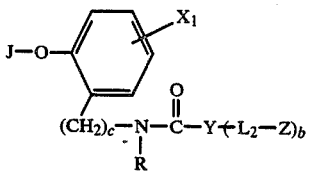

(wherein R represents a hydrogen atom, an alkyl group having 1 to 4 carbon atoms, or an aryl group having 6 to 10 carbon atoms; $X_1$ represents a hydrogen atom, a halogen atom, a cyano group, a nitro group, an alkyl group having 1 to 10 carbon atoms, or a group represented by $-OR_4$, $-COOR_4$, $-CONHR_4$, $-NHCOR_4$, $-NHSO_2R_4$, $-SO_2NHR_4$ or $-SO_2R_4$ wherein $R_4$ represents an alkyl group having 1 to 20 carbon atoms or an aryl group having 6 to 20 carbon atoms; and c represents an integer of 0 to 2);

$L_2$ represents a linking group containing a chemical bond to be split in a developer, and represented together with the positions at which Y and Z substitute by the following formulae:

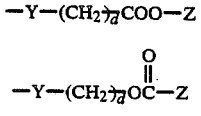

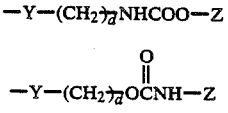

-continued

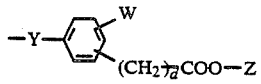

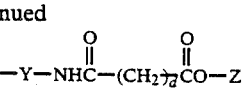

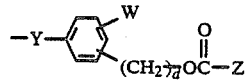

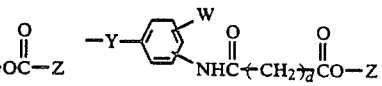

(wherein d represents an integer of 0 to 10; W is selected from the group consisting of a hydrogen atom, a halogen atom, an alkyl group containing 1 to 10 carbon atoms, an alkanamido group containing 1 to 10 carbon atoms, an alkoxy group containing 1 to 10 carbon atoms, an alkoxycarbonyl group containing 1 to 10 carbon atoms, an aryloxycarbonyl group, an alkanesulfonamido group containing 1 to 10 carbon atoms, an aryl group, a carbamoyl group, an N-alkylcarbamoyl group containing 1 to 10 carbon atoms, a nitro group, a cyano group, an arylsulfonamido group, a sulfamoyl group, and an imido group);

a represents 0 or 1; and b represents 1 or 2, and when b represents 2, —$L_2$—Z)'s may be the same or different.

11. A color photographic material comprising a support having provided thereon a blue-sensitive silver halide emulsion layer containing at least one coupler capable of reacting with an oxidation product of an aromatic primary amine developing agent to form a yellow dye, and at least one coupler capable of reacting with said oxidation product to produce both a cyan dye and a diffusible development inhibitor or a precursor thereof, wherein the at least one coupler forming the yellow dye and the at least one coupler producing both a cyan dye and a diffusible development inhibitor or a precursor thereof are present in the same blue-sensitive silver halide emulsion layer.

12. A color photographic material as in claim 11, wherein said at least one coupler capable of reacting with said oxidation product to produce both a cyan dye and a diffusible development inhibitor or a precursor thereof is a DIR coupler represented by formula (VII)

$$J-(L_1)_a-Y-L_2-Z)_b \quad \text{(VII)}$$

wherein J represents a coupler moiety;

Y represents an essential moiety of a compound showing development-inhibiting effect, and is bound to the coupling position of said coupler moiety directly (when a is 0) or through linking group $L_1$ (when a is 1);

Z represents a substituent bound to Y through linking group $L_2$ and capable of making the development-inhibiting effect of Y emerge;

$L_1$ represents a linking group selected from the group consisting of groups represented together with J and Y—($L_2$—Z) by the following formulae:

$$J-OCH_2-Y-(L_2-Z)_b$$
$$J-SCH_2-Y-(L_2-Z)_b$$

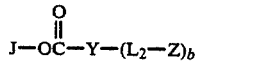

-continued

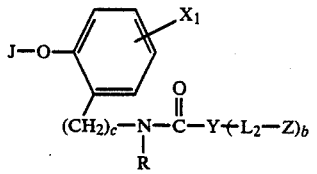

(wherein R represents a hydrogen atom, an alkyl group having 1 to 4 carbon atoms, or an aryl group having 6 to 10 carbon atoms; $X_1$ represents a hydrogen atom, a halogen atom, a cyano group, a nitro group, an alkyl group having 1 to 10 carbon atoms, or a group represented by $-OR_4$, $-COOR_4$, $-CONHR_4$, $-NHCOR_4$, $-NHSO_2R_4$, $-SO_2NHR_4$ or $-SO_2R_4$ wherein $R_4$ represents an alkyl group having 1 to 20 carbon atoms or an aryl group having 6 to 20 carbon atoms; and c represents an integer of 0 to 2);

$L_2$ represents a linking group containing a chemical bond to be split in a developer, and represented together with the positions at which Y and Z substitute by the following formulae:

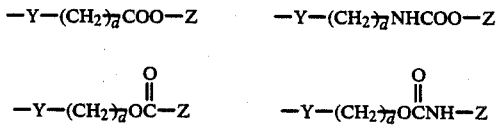

-continued

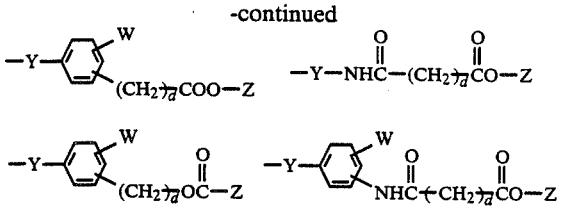

(wherein d represents an integer of 0 to 10; W is selected from the group consisting of a hydrogen atom, a halogen atom, an alkyl group containing 1 to 10 carbon atoms, an alkanamido group containing 1 to 10 carbon atoms, an alkoxy group containing 1 to 10 carbon atoms, an alkoxycarbonyl group containing 1 to 10 carbon atoms, an aryloxycarbonyl group, an alkanesulfonamido group containing 1 to 10 carbon atoms, an aryl group, a carbamoyl group, an N-alkylcarbamoyl group containing 1 to 10 carbon atoms, a nitro group, a cyano group, an arylsulfonamido group, a sulfamoyl group, and an imido group);

a represents 0 or 1; and b represents 1 or 2, and when b represents 2, $-L_2-Z$)'s may be the same or different.

13. A color photographic material as in claim 1 which exhibits improved yellow-green reproducibility.

14. A color photographic material as in claim 11, which exhibits improved yellow-green reproducibility.

15. A color photographic material as in claim 1, containing from 0.01 to 0.5 mole of the coupler forming the yellow dye, from $1\times10^{-2}$ to $5\times10^{-1}$ mole of the coupler forming the cyan dye and from $3\times10^{-3}$ to $1\times10^{-1}$ mole of the compound producing a diffusible development inhibitor or a precursor thereof.

* * * * *